United States Patent [19]

Stoler

[11] 4,136,647

[45] Jan. 30, 1979

[54] ROTARY DEVICE PARTICULARLY USEFUL AS A ROTARY ENGINE

[76] Inventor: Moshe Stoler, 10 Tirosh St., Ramat Hasharon, Israel

[21] Appl. No.: 791,326

[22] Filed: Apr. 27, 1977

[51] Int. Cl.[2] ..... F02B 75/28

[52] U.S. Cl. ..... 123/45 R; 123/51 A; 277/75

[58] Field of Search ..... 123/51 R, 51 A, 51 BD, 123/51 AA, 45 R, 45 A; 418/68; 277/75, 76

[56] References Cited

U.S. PATENT DOCUMENTS

| | | | |
|---|---|---|---|
| 1,430,602 | 10/1922 | Sykora | 418/68 X |
| 1,788,140 | 1/1931 | Woolson | 123/51 AA |
| 1,808,083 | 6/1931 | Tibbetts | 123/51 AA X |
| 1,867,504 | 7/1932 | Franklin | 123/45 A X |
| 1,990,618 | 2/1935 | Schoene | 277/75 X |
| 2,288,480 | 6/1942 | Palumbo | 123/45 A X |
| 2,473,936 | 6/1949 | Burrough | 123/45 R |

FOREIGN PATENT DOCUMENTS

| | | | |
|---|---|---|---|
| 2514480 | 10/1975 | Fed. Rep. of Germany | 123/45 R |
| 2421686 | 11/1975 | Fed. Rep. of Germany | 418/68 |
| 46-19201 | 5/1971 | Japan | 123/51 R |

*Primary Examiner*—Carlton R. Croyle
*Assistant Examiner*—Michael Koczo, Jr.
*Attorney, Agent, or Firm*—Benjamin J. Barish

[57] ABSTRACT

A rotary device particularly useful as a rotary engine comprises a cylinder having two (or more) pairs of axially displaceable pistons, the pistons of each pair being movable towards and away from each other to define an expansible and contractable chamber therebetween. Each chamber includes fuel intake openings, exhaust openings, and spark plugs. The inner surface of the cylinder, and the outer surface of the pistons, include cooperable cam and follower means such that the displacement of the two pistons in each pair towards and away from each other also imparts a rotary motion to the pistons, the side walls of the pistons being formed with gear teeth coupling the pistons to a rotary output shaft.

3 Claims, 4 Drawing Figures

FIG. 4
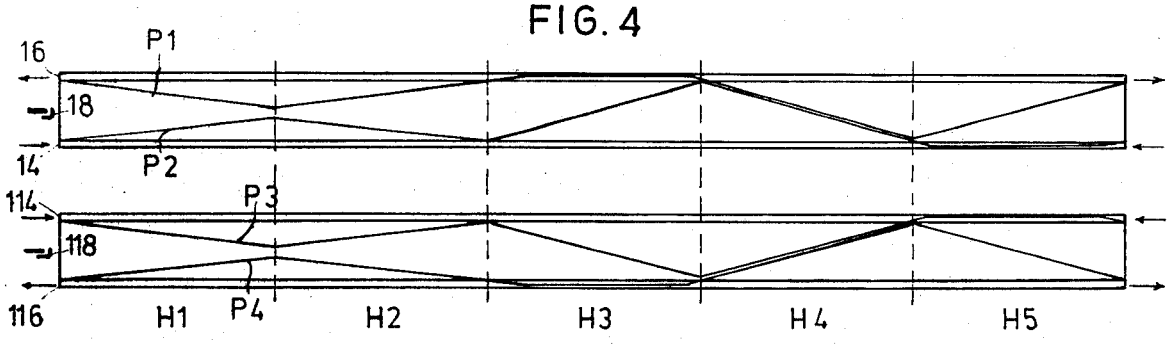
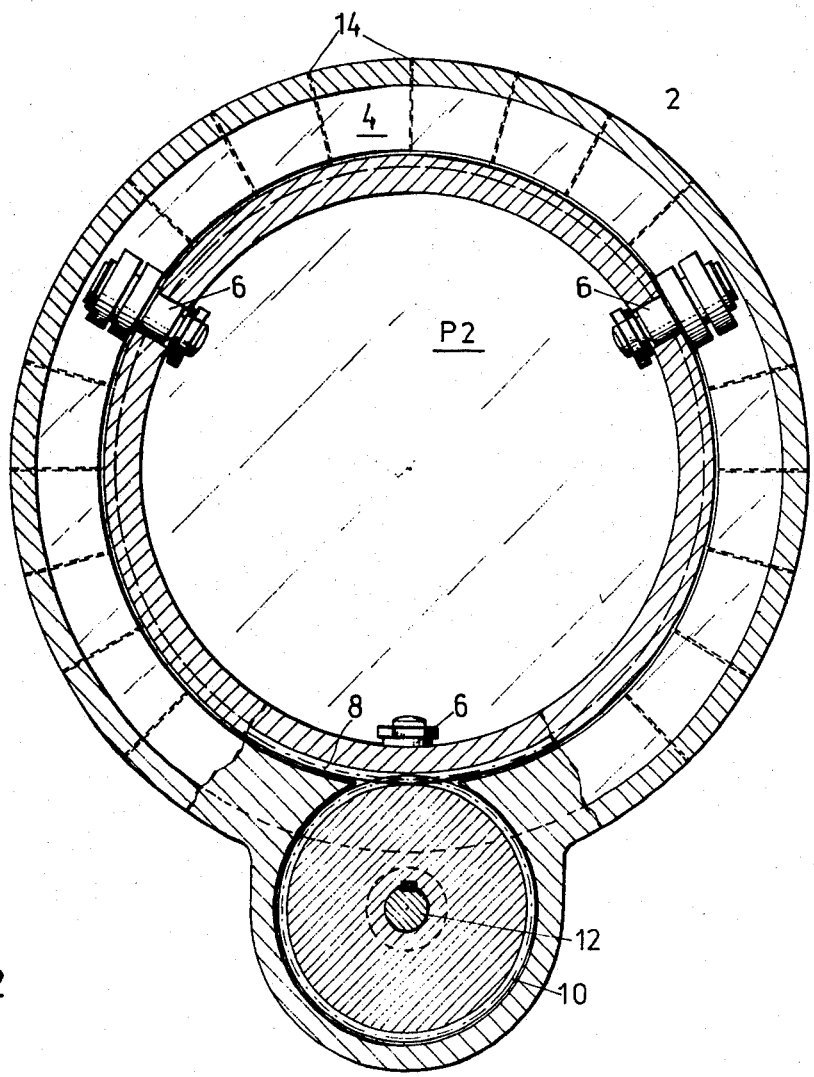
FIG. 2

ROTARY DEVICE PARTICULARLY USEFUL AS A ROTARY ENGINE

BACKGROUND OF THE INVENTION

The present invention relates to rotary devices. The invention is particularly applicable with respect to rotary engines, and is therefore described below in connection with such an application, but it will be appreciated that it could be used in other applications, such as rotary pumps.

A large number of rotary engines have been devised, probably the best known example being the Wankel engine. As a rule, however, the known rotary engines suffer from sealing problems which have not yet been satisfactorily overcome. In addition, in most types of rotary engines, there is an incomplete exhaust of gases, which undersirably affects engine efficiency and ecological conditions.

An object of the present invention is to provide a new form of rotary device particularly useful as a rotary engine having advantages in the above respects.

SUMMARY OF THE INVENTION

According to the present invention, there is provided a rotary device comprising: a cylinder; a pair of pistons displaceable axially in the cylinder towards and away from each other to define an expansible and contractable chamber therebetween; a fluid inlet to the chamber; and a fluid outlet from the chamber. The inner face of the cylinder, and the outer faces of the pistons are formed with cooperable cam and follower means such that the displacement of the pistons towards and away from each other also imparts a rotary motion to the pistons. The device further includes rotary coupling means coupling the pistons to a rotary shaft.

In the preferred embodiment of the invention described below, the cooperable cam and follower means comprises cam slots formed in the inner surface of the cylinder, and cam followers carried by the outer surfaces of the pistons.

The invention is particularly applicable to rotary engines, wherein the fluid inlet is a fuel intake, the fuel outlet is a spent-gas exhaust, the chamber further includes means for igniting the fuel inletted through the fuel intake, and the rotary shaft is an output drive shaft.

Preferably, the rotary device includes two (or more) pairs of pistons all of the pistons being coupled to the rotary shaft.

Further features and advantages of the invention will be apparent from the description below.

BRIEF DESCRIPTION OF THE DRAWINGS

The invention is herein described, by way of example only, with reference to the accompanying drawings, wherein:

FIG. 2 is a transverse sectional view along lines II — II of FIG. 3;

FIG. 4 is a diagram illustrating the axial displacement phases of the pistons during each operational cycle, occurring during each one-third revolution, of the engine of FIG. 1.

DESCRIPTION OF THE PREFERRED EMBODIMENT

Figure 1:
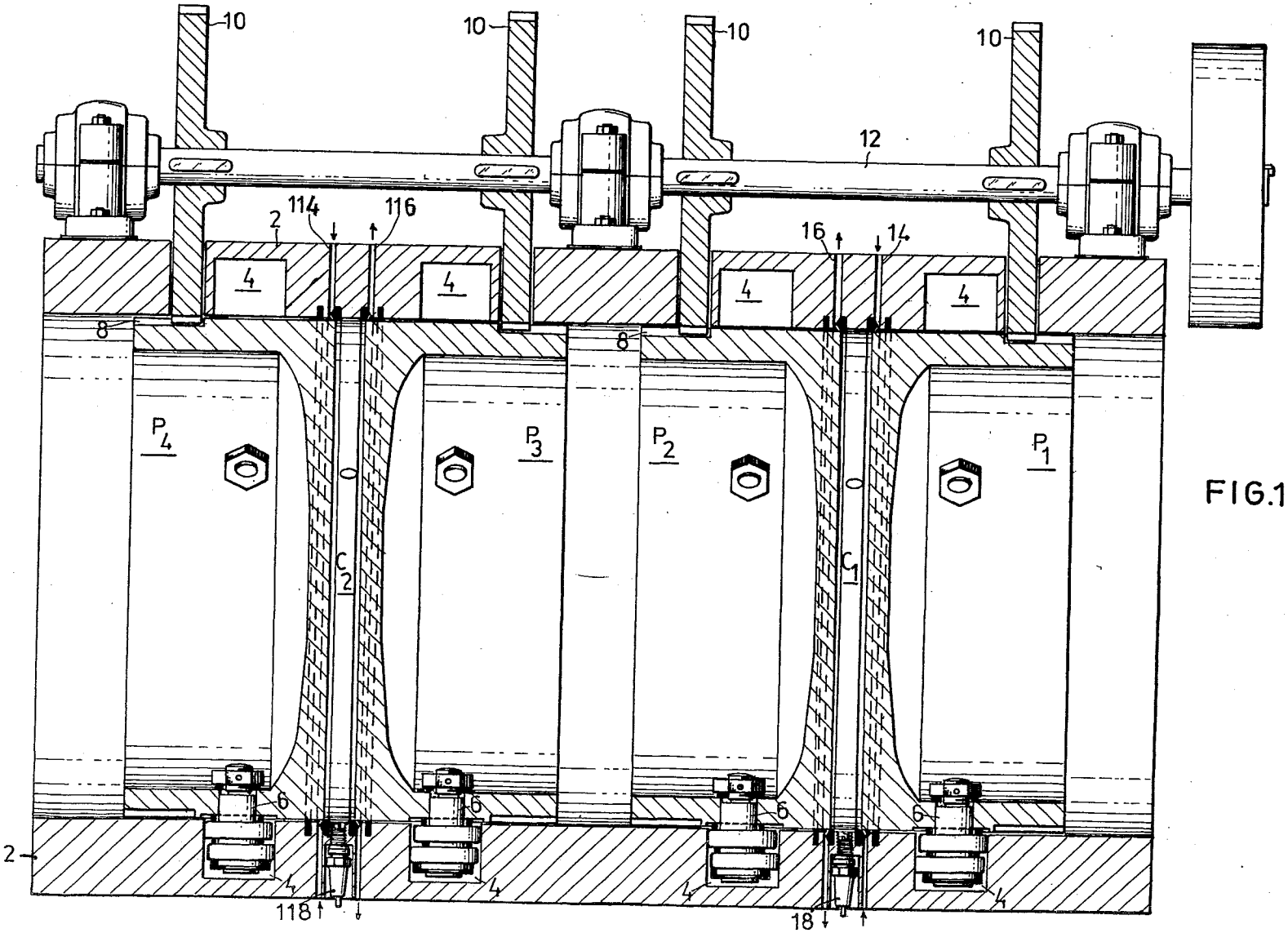
FIG. 1 is a longitudinal sectional view illustrating one form of rotary engine constructed in accordance with the invention.

The rotary engine illustrated in the drawings comprises a cylinder, generally designated 2, having a pair of pistons P1, P2, axially displaceable within the cylinder towards and away from each other to define an expansible and contractable chamber C1 between them. Cylinder 2 includes a second pair of pistons P3, P4 also axially displaceable towards and away from each other to define a second chamber C2. The inner surface of cylinder 2 is formed with cam slots 4 cooperable with cam followers 6 carried by each piston, such that the displacement of the pistons towards and away from each other also imparts a rotary motion to the pistons as will be described more particularly below with respect to the diagram of FIG. 4. Each of the pistons includes gear teeth 8 meshing with gears 10 fixed to an output drive shaft 12, which shaft is rotated upon the rotation of the pistons.

Cylinder 2 further includes: an inlet or fuel intake 14 into chamber C1 defined by pistons P1, P2; an outlet or spentgas exhaust 16 from chamber C1; and spark plugs 18 for igniting the fuel within the chamber. Similar elements are found in chamber C2 defined by pistons P3, and P4, the latter elements being correspondingly numbered 114, 116 and 118. The structure of the engine with respect to chamber C1 is more particularly illustrated in FIGS. 2 and 3, it being understood that the identical structure, but in a mirror-image relationship, is also present with respect to chamber C2.

Figure 3:
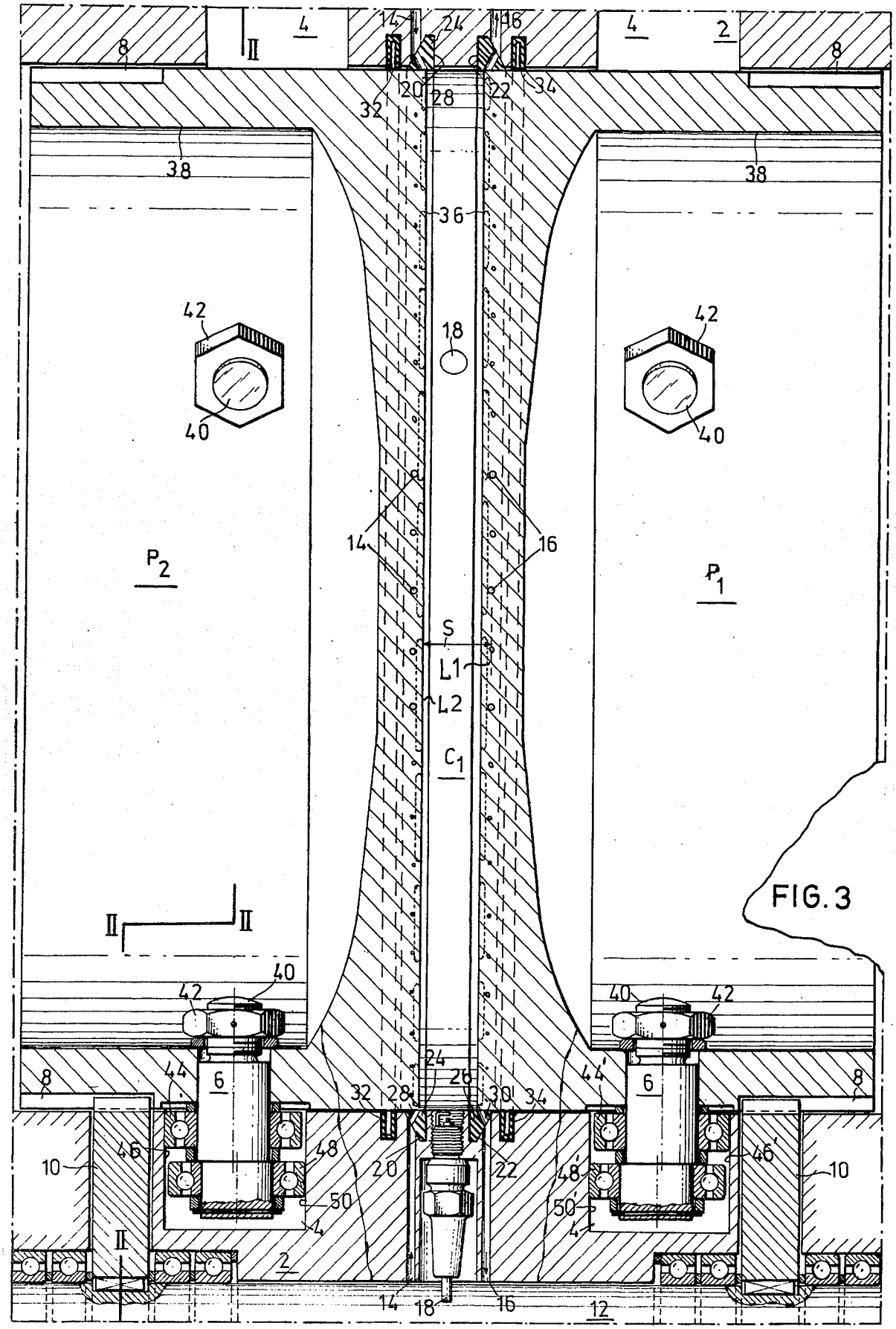
FIG. 3 is an enlarged longitudinal view illustrating more particularly the construction of one pair of the pistons included in the engine of FIG. 1.

Thus, as particularly shown in FIG. 3, the intake 14 is in the form of an annular array of openings on one side of the expansible and contractable chamber C1, and the exhaust 16 is in the form of a second annular array of openings at the opposite side of this chamber. The inner ends of the intake openings 14 terminate in an annular recess 20 formed in the inner surface of cylinder 2, and the inner ends of the exhaust openings 16 similarly terminate in a second annular recess 22 formed in the inner surface of the cylinder. A sealing ring 24 is seated within recess 20, and a second sealing ring 26 is seated within recess 22. Sealing ring 24 is formed with an annular array of openings or passages 28 therethrough aligned with the intake openings 14 for establishing communication from the latter into chamber C1; and sealing ring 26 is formed with a similar annular array of openings or passages 30 therethrough aligned with the exhaust openings 16 for establishing communication to the latter from chamber C1.

In the embodiment illustrated in the drawings, cylinder 2 supports three spark plugs 18 equally spaced around the circumference of chamber C1 between the intake openings 14 and the exhaust openings 16. In addition, an oil ring 32 is provided on cylinder 2 on the side of sealing ring 24 opposite to spark plugs 18, and another oil ring 34 is provided on the side of sealing ring 26 opposite to spark plugs 18.

Each of the pistons P1, P2 includes a circular end face 36 and a cylindrical side wall 38. The outer surfaces of the piston side walls 38 carry the cam followers 6 which are movable within the cam slots 4 of cylinder 2. In the illustrated embodiment, each piston is provided with three such cam followers equally spaced around its circumference.

Each of the cam followers 6 includes a shank 40 fixed, as by a nut 42, to the inner surface of its respective piston and projecting past its outer surface into slot 4 formed in the inner surface of the cylinder 2. The outer end of shank 40 supports a two-section bearing, namely an inner annular bearing section 44 engaging side wall 46 of the cam slot 4 during certain operational phases of the engine, and an outer annular bearing section 48 engaging the opposite side wall 50 of cam slot 4 during other operational phases, as described more particularly below. Such a two-section bearing provides a low-friction cam follower coupling between the pistons and the cylinder 2, which causes the pistons to rotate as they are moved in the axial direction by the ignition of the fuel within chamber C1.

The maximum axial displacement of each piston, as permitted by the cam slots 4, is indicated by the distance "S" in FIG. 3 with respect to piston P1. Thus, piston P1 (normally on the exhaust or outlet side, defined by exhaust openings 16, of chamber C1 and therefore later referred to as the exhaust or outlet piston) may move in an axial direction from one extreme position illustrated by broken line L1, wherein it just uncovers completely passages 30 through sealing ring 26 over the exhaust openings 16, to an opposite extreme position which is the illustrated full-line position (L2) of piston P2, just short of uncovering passages 28 in the sealing ring 24 over the intake openings 14. Similarly, piston P2 (normally on the inlet or intake side of chamber C1, and therefore hereinafter sometimes referred to as the inlet or intake piston) may also move a corresponding maximum axial displacement, from one extreme position wherein it just uncovers completely passages 28 through sealing ring 24 over the intake openings 14, to the opposite extreme position just short of uncovering passages 30 through sealing ring 26 over the exhaust openings 16.

The operation of the rotary engine will now be described with reference to the phase diagram of FIG. 4, which illustrates the axial displacement of the two pairs of pistons (P1, P2 and P3, P4) defining the two compartments C1 and C2, respectively, during one operational cycle of the engine. The phase diagram of FIG. 4 illustrates only one-third revolution (i.e. 120°) of each piston; that is, each complete revolution (360°) of the pistons will drive the engine through three of the operational cycles illustrated in FIG. 4. It will be appreciated, however, that the number of operational cycles for each revolution of the engine is determined by the slots 4 and can be varied according to any particular design requirements.

It is assumed for purposes of the following description that the operational cycle starts with the beginning of the compression phase. At the beginning of this phase, the outlet or exhaust pistons P1, P4 just cover the passages 30, 130 through the sealing rings (26) over the exhaust openings 16, 116, and the inlet or intake piston P2, P3 just cover the passages 28, 128 through the sealing rings (24) over the intake openings 14, 114. Eachpair of pistons P1, P2 and P3, P4 defining the two compartments C1 and C2, respectively, are then driven through the following five phases:

(1) a compression phase H1, wherein pistons P1, P2, move towards each other (wall 46 bearing against the inner bearing section 44 in piston P2), and pistons P3, P4 also move towards each other, until the faces of the two pistons of each pair are at their minimum distance apart on each side of their respective spark plugs 18, 118; ignition occurs substantially at the end of this compression phase;

(2) an expansion phase H2, wherein the two pistons in each pair move away from each other (bearing section 44 in piston P2 bearing against wall 46), the phase ending when the faces of the exhaust pistons P1, P4 just reach the exhaust openings 16, 116, and the faces of the intake pistons P2, P3 just reach the intake openings 14, 114;

(3) an exhaust phase H3, during which the faces of the exhaust pistons P1, P4 uncover the exhaust openings 16, 116 and then substantially maintain this axial position with the exhaust openings uncovered, while the intake pistons P2, P3 move towards their respective exhaust pistons P1, P4 to effect a complete exhaust through the uncovered exhaust openings, whereupon the exhaust pistons P1, P4 start to move back to cover their respective exhaust openings 16, 116;

(4) a neutral phase H4, wherein the faces of each pair of pistons P1, P2 and P3, P4 move together towards the intake openings 14, 114 (wall 50 now bearing against outer bearing section 48 in piston P2, and wall 46' now bearing against bearing section 44' in piston P1), the phase ending when the faces of both pairs reach, but do not uncover, the respective intake openings; and (5) a suction phase H5, wherein the faces of the intake pistons P2, P3 uncover their respective intake openings 14, 114, and the faces of the exhaust pistons P1, P4 move towards their respective exhaust openings 16, 116 (wall 50' now bearing against bearing section 48' of piston P1), thereby effecting the induction of fuel into the respective chambers C1, C2; at the end of this phase, the intake pistons P2, P3 move back to cover their respective intakes, the exhaust pistons P1, P4 having reached their respective exhaust openings 16, 116, whereupon the pistons are in their initial positions for the beginning of a compression phase in the next operational cycle.

It will be seen that in the exhaust phase H3, pistons P2 and P3 move in opposite directions, and in the neutral phase H4, piston pair P1, P2 move together in one direction, and piston pair P3, P4 move together in the opposite direction. Thus, for balancing purposes, there will always be two pistons moving in one direction, and two pistons moving in the opposite direction.

It will be appreciated that while the pistons are being thus moved in the axial direction by the ignition of the fuel within chambers C1, C2, the cams 6 on the pistons moving in slots 4 in the cylinder 2 cause the pistons to rotate, their rotary motion being coupled to the output drive shaft 16 via gears 8 and 10.

For purposes of example, each piston may have a diameter of about 350 mm, and have a total axial displacement ("S") of about 22 mm.

While the invention has been described with respect to the use of two pairs of pistons, it will be appreciated that more than two pairs could be used, but preferably an even number of pairs for balancing purposes. Also, while the phase diagram of FIG. 4 illustrates the five phases as being of substantially equal duration, it will be appreciated that the durations of the phases could be unequal, according to the particular design requirements, and that the direction changes of the pistons would normally be more gradual than illustrated. Further, the sealing rings (24, 26) may be designed so as to be carried by the pistons instead of the cylinder. Also, while the invention has been described particularly with respect to a 5-stroke spark-plug type engine, it will be appreciated that it could be used in 2-stroke diesel engines, or other rotary devices, for example rotary pumps.

Many other variations, modifications and applications of the illustrated embodiment of the invention will be apparent.

What is claimed is:

1. A rotary engine, comprising: a fixed cylinder; a least one pair of pistons displaceable in the cylinder towards and away from each other to define an expansible and contractable chamber therebetween; a first annular recess formed in said fixed cylinder on one side of the expansible and contractable chamber; a first annular array of fuel intake openings formed through said fixed cylinder and communicating with said first annular recess; means for igniting the fuel inletted through said fuel intake openings; a second annular recess formed in said fixed cylinder on the opposite side of said expansible and contractable chamber; a second annular array of exhaust openings formed through said fixed cylinder and communicating with said second annular recess; a sealing ring disposed in each of said annular recesses in the fixed cylinder and formed with an annular array of openings aligned with the respective openings through the fixed cylinder communicating with the respective annular recess; the inner surface of said cylinder being formed with cam slots, and the outer surface of said pistons including cooperable cam follower means such that the displacement of said pistons axially towards and away from each other effects a rotation of said pistons with respect to said cylinder; and a rotary output drive shaft coupled to said rotating pistons.

2. A rotary engine according to claim 1, wherein the device includes at least two pairs of said pistons all coupled to said rotary shaft.

3. A rotary engine according to claim 1, wherein, when the pistons are at maximum distances apart from each other, the fluid inlet is adjacent to and is uncovered by one piston, called the inlet piston, and the fluid outlet is adjacent to and uncovered by the other piston, called the outlet piston; and wherein, during each operational cycle, said pistons are axially displaced through:

(a) a compression phase, wherein the two pistons are moved from initial positions, covering both the fluid inlet and outlet, towards each other to compress the fluid;

(b) an expansion phase, wherein the two pistons are moved away from each other until they reach the fluid inlet and outlet, respectively;

(c) an exhaust phase, wherein the outlet piston is moved to uncover the outlet, and the inlet piston is moved from the inlet towards the outlet piston reaching same at the end of the phase to effect the exhaust through the outlet;

(d) a neutral phase, wherein both pistons are moved together to the inlet; and (e) a suction phase, wherein the inlet piston is moved to uncover the inlet at the beginning of the phase and is returned to cover same at the end of the phase, and the outlet piston is moved towards the outlet to reach and cover same at the end of the phase.

* * * * *